US005190266A

United States Patent [19]

Barrera

[11] Patent Number: 5,190,266

[45] Date of Patent: Mar. 2, 1993

[54] DECKING CLAMP AND SPACER

[76] Inventor: John Barrera, 1701 Tuckerton Ave., Whiting, N.J. 08759

[21] Appl. No.: 872,040

[22] Filed: Apr. 23, 1992

[51] Int. Cl.[5] ..... B66F 3/00

[52] U.S. Cl. ..... 254/17; 269/904; 269/43

[58] Field of Search ..... 33/526, 527, 613, 501; 144/288.5; 269/43, 904, 910; 52/127.2, 749; 254/15-17

[56] References Cited

U.S. PATENT DOCUMENTS

| | | | |
|---|---|---|---|
| 1,834,026 | 12/1931 | Hall | 269/904 |
| 2,823,011 | 2/1958 | Jones | 254/15 |
| 3,134,573 | 5/1964 | Bizjak | 254/17 |
| 3,220,691 | 11/1965 | Dudley | 254/15 |
| 3,779,515 | 12/1973 | Larios et al. | 254/16 |
| 4,237,614 | 12/1980 | Williams | 269/904 |
| 4,809,439 | 3/1989 | Burns | 33/527 |

*Primary Examiner*—Robert C. Watson
*Attorney, Agent, or Firm*—Clifford G. Frayne

[57] ABSTRACT

An articulating lever assembly for straightening and installation of deck boards, the lever assembly having a generally-horizontal first arm member pivotly secured to a generally-vertical second arm member, one end of the first arm member engageable between secured deck boards, and the lower end of the second arm member engageable with the edge of a deck board to be secured, leverage action on the handle end of the second arm member causing the cross member to engage the edge of the deck board to be secured and straighten the deck board prior to securing the deck board to the underlying joist.

2 Claims, 3 Drawing Sheets

DECKING CLAMP AND SPACER

BACKGROUND OF THE INVENTION

1. Field of the Invention

The present invention relates to a decking tool and, in particular, a lever and spacer assembly which permits the user to align the boards and space the boards with one hand, leaving the other hand free to drive the nail.

2. Description of the Prior Art

Outdoor decks and patios have become increasingly popular in recent years and kits and do-it-yourself books are availably to allow the homeowner as well as the construction professional to construct elaborate wooden decks and patios. The aesthetic appearance of the deck is usually judged by the appearance of the deck boards and their spacing and appearance. The deck boards are the final item normally installed after the deck joists have been positioned and leveled.

In many instances, especially working with longer deck boards, they will be warped or bowed as opposed to being perfectly straight. This oftentimes necessitates discarding the deck board or obtaining the help of several individuals in order to force it into position and obtain the correct spacing between the warped or bowed board and the immediate adjacent board which has already been positioned and secured to the joists.

The present invention addresses the problem of these warped or bowed boards through the use of a lever assembly and special spacer assembly which allows an individual, without the aid of other individuals, to straighten the bowed or warped board along its length as it is secured to the floor joists while automatically setting the appropriate space between the board being installed and the immediate adjacent board which has already been secured to the joist. The entire procedure can be accomplished by the individual/user without the need for any additional assistance and is also operative with only one hand of the individual/user, leaving the other hand free for driving the nail through the decking plank to the underlying joist to secure the board. This allows the individual/user to move along the boards securing it to the selective joist and then positioning a new board and repeating the procedure as the individual/user works his or her way across the decking joist.

OBJECTS OF THE INVENTION

An object of the present invention is to provide for a novel decking tool which allows the individual/user to place and secure warped or bowed deck boards.

A further object of the present invention is to provide for a novel decking took which allows the individual-/user to place and secure warped or bowed deck boards without any additional assistance.

A still further object of the present invention is to provide for a novel decking tool which allows for the installation of warped or bowed deck boards with one hand, leaving the other hand free to secure the warped or bowed deck board to the underlying joist.

A still further object of the present invention is to provide for an articulating lever apparatus for installing warped or bowed deck boards, which compensates for the warped or bowed deck board and also simultaneously sets the spacing between the warped or bowed deck board and the adjacent secured deck board.

SUMMARY OF THE INVENTION

An L-shaped articulating lever apparatus for the installation of deck boards, the lever apparatus having a first arm member oriented in a generally-horizontal plane and pivotly secured to a second arm member generally oriented in a vertical plane. The first arm member has a 90° lip formed at one end thereof for engagement with a deck board which has already been secured and has slidably positioned thereon, a spacer element for positioning between the secured board and a deck board to be secured, the second arm member having a cross member formed thereon for engagement with the edge of the deck board to be secured, the pulling of the vertical second arm member results in a pivotal action in which the cross member applies pressure to the board to be secured and pushes it against the spacer element thus straightening out the board before it is secured.

BRIEF DESCRIPTION OF THE DRAWINGS

These and other objects of the present invention will become apparent particularly when taken with respect to the accompanying drawings wherein.

DETAILED DESCRIPTION OF THE DRAWINGS

Figure 1:
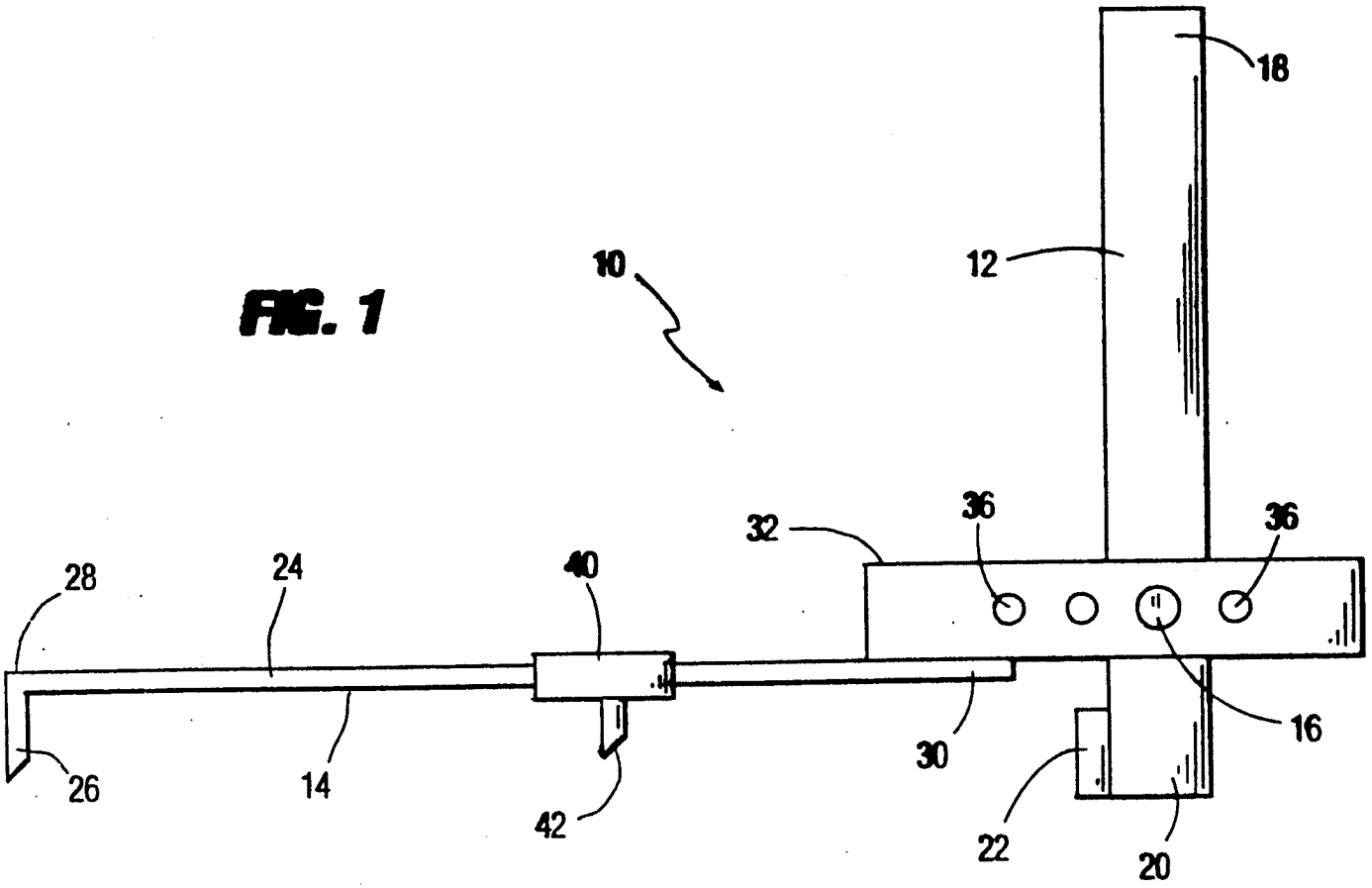
FIG. 1 is a side view of the decking tool.

FIG. 1 is a side elevational view of the decking tool 10. Decking tool 10 comprises a first board engaging member 12 which is in pivotal connection with second board engaging member about pivot point 16. In use, first board engaging member 12 is normally positioned in a substantially vertical position with its upper end 18 comprising the handle for the introduction of leverage by the user. Lower end 20 of first board engaging member 12 has a board engaging cross member 22 for engagement with the edge of the decking board to be installed.

Second board engaging member 14, when in use, is positioned in a substantially horizontal plane. Second board engaging member 14 comprises a generally flat planer arm 24 having a lip 26 positioned on its first end 28. Lip 26 for the purpose of installing wooden planks for decking, would be in approximately 90° relationship with respect to planer arm 24 Second end 30 of planer arm 24 would be rigidly secured to pair of support arms 32 and 34 (see FIG. 2). Support arms 32 and 34 are secured perpendicularly to planer arm 24 and extend beyond end 30 of planer arm 24. Support arms 32 and 34 have a plurality of apertures 36 aligned therethrough to allow for adjustment of second board engaging member 14 relative to first board engaging member 12 about pivot point 16.

Figure 2:
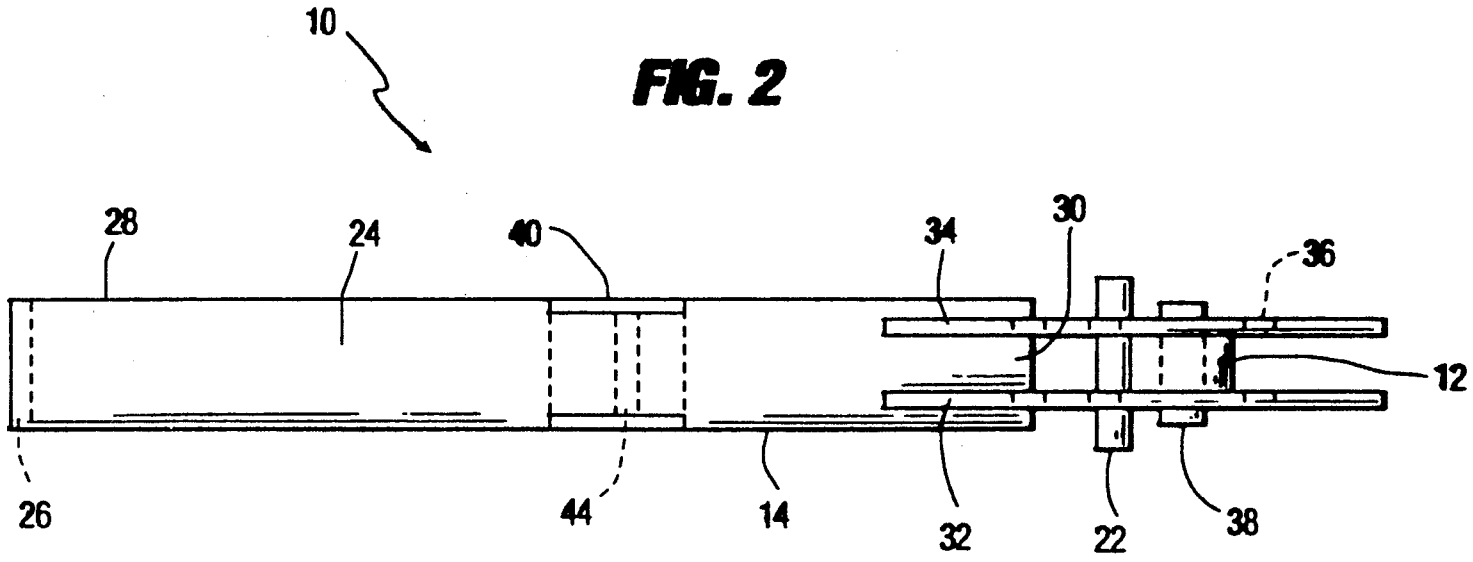
FIG. 2 is a top view of the decking tool.

FIG. 2 is a top plan view of decking tool 10 in which the relationship between planer arm 24 of second board engaging member 14 and support arms 32 and 34 is more readily discernible. In this configuration, support arms 32 and 34 are secured to the upper surface of planer arm 24. They extend beyond the second end 30 of planer arm 24 in parallel relationship with each other having the alignable apertures 36 positioned therethrough to allow the user to selectively engage support arms 32 and 34 with first board engaging member 12.

First board engaging member 12 has an aperture therethrough alignable with the apertures in support arms 32 and 34 to allow the user to adjust the distance between lip 26 on planer arm 24 and cross member 22 secured to the lower end 20 of first board engaging member 12. The distance so chosen by the user is fixed through the use of a securing means 38 such as a bolt and cotter pin connection so as to allow the pivotal relationship between first board engaging member 12 and second board engaging member 14.

Figure 3:
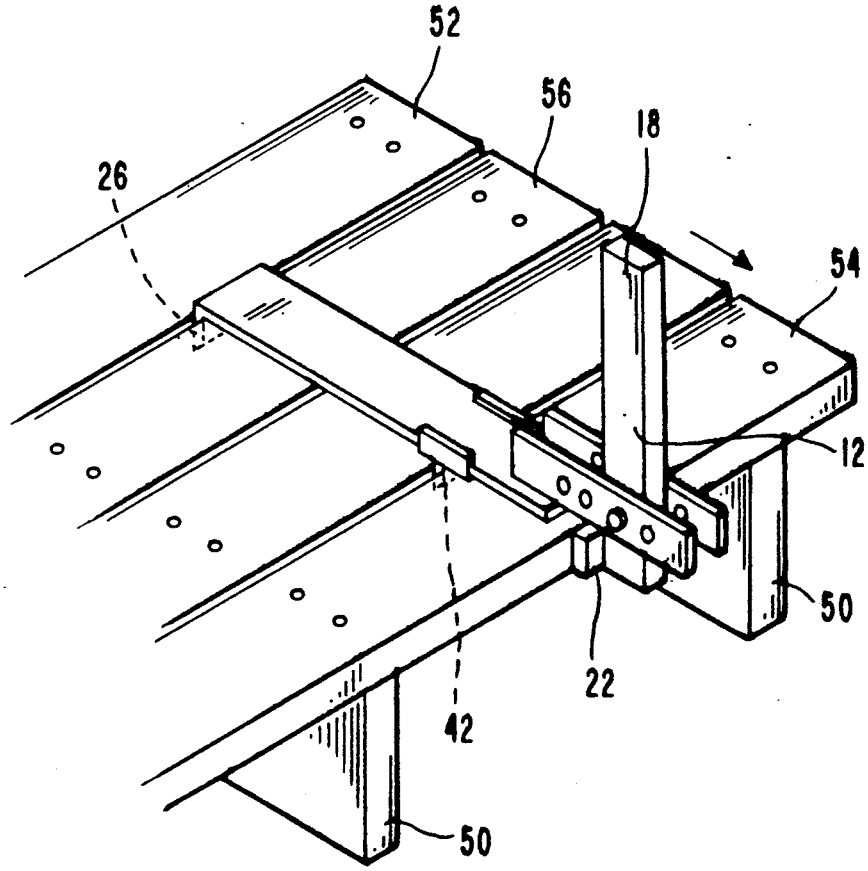
FIG. 3 is a perspective view illustrating the manner of use of the decking tool with relationship to the installation of a deck.

This distance between lip 26 and cross member 22 is adjusted by the user to accommodate varying widths of deck planking and the relationship will become apparent with reference to FIG. 3.

Decking tool 10 as described thus far is sufficient for its intended purpose as will be set forth hereafter. In normal operation, the user, in installing a deck, will set the space between boards through the use of a nail or other device which approximates the distance between the boards which the installer wishes to obtain. Decking tool 10 can alleviate this additional step by having positioned on planer arm 24, a slidable spacer element 40 which is freely slidable and adjustable on planer arm 24 and has a depending vertical tooth 42 dimensioned to the standard preferred distance recommended between boards for decking. This slidable adjustable spacer element 40 relieves the installer of the additional task of positioning nails or other suitable devices to establish the distance between boards and allows for the faster and easier installation of decking boards.

FIG. 3 is a perspective view of decking tool 10 in use in the installation of deck boards. The joists 50 have been installed and leveled and the installer has positioned his first board perpendicular to the joists and secured it to the joists. Working off of this initial deck board, the installer would proceed to work his way across the deck installing subsequent boards. The installer would, in all likelihood, have chosen the straightest board available for his initial board installation. Thereafter, decking tool 10 would allow the installer to adjust for warped or bowed boards which were encountered during the installation procedure. The user would engage lip 26 between installed planks 52. The user would then position finger 42 of slidable element 40 between the last installed board 52 and the board to be installed 54. The installer has therefore set the width between the board to be installed and the boards already installed and by pulling on handle end 18 of first board engaging member 12, causes cross member 22 to exert pressure on board 54 to close any gap between board 54 and the last installed board 52 which is greater than the width of finger 42 of slidable adjustable element 40. The operator can normally exert sufficient pressure with one hand to bring the boards into alignment such that his second hand is free to drive a nail through the board and into the adjacent joist thereby securing board 54. The installer would then move along board 54 which is being installed to the next joist and repeat the procedure.

FIG. 3 illustrates the use of decking tool 10 with deck boards of relatively narrow width, hence, lip 26 of planer arm 24 engages the gap between installed boards, two (2) boards from the board to be installed. The plurality of apertures 36 of support arms 32 and 34 allow for adjustment such that when boards of greater width are encountered, lip 26 may engage the gap between boards only one board away from the board to be installed. Regardless of the engagement distance, the function of decking tool 10 will remain the same.

While the invention has been described with reference to its preferred embodiment therefor, it will be appreciated by those of ordinary skill in the art that various changes can be made to the apparatus without departing from the basic spirit and scope of the invention.

What is claimed is:

1. An articulating lever assembly for straightening, installation and securing of warped or bowed deck boards to the underlying joists, the assembly comprising:

a first arm member having a board-engaging lip-formed on the first end thereof for engagement between secured deck boards, a second arm member having a first handle end and a second end having a board-engaging cross member for engagement with he edge of a deck board to be secured, said first arm member pivotally secured to said second arm member above said cross member, said first arm member comprising a generally planar portion having said board-engaging lip formed thereon and a pair of support arms perpendicularly secured to said planar portion opposite said first end, si support arms having a plurality of apertures aligned therethrough, said apertures alignable with an aperture in said second arm member for receipt of a securing means for pivotal engagement of said first member to said second arm member, said plurality of apertures in said support arm providing for adjustment of distance between said cross member of said second arm member and said board-engaging lip of said first arm member to accommodate deck boards of different widths, said cross member of said a second arm member cooperative with said lip of said first arm member straightening and position said deck boards to be installed.

2. The articulating lever assembly in accordance with claim 1 wherein said first arm member has positioned thereon, a spacer member, said spacer member slidable on said first arm member, said spacer member having a downwardly-depending finger for positioning between said secured deck board and said deck board to e secured, said downwardly-depending finger defining the space between said deck boards.

* * * * *